US010618686B2

(12) United States Patent
Hammond et al.

(10) Patent No.: US 10,618,686 B2
(45) **Date of Patent: *Apr. 14, 2020**

(54) CLOSURE FOR A CONTAINER, CLOSURE COMPONENTS, AND METHOD OF USE THEREOF

(71) Applicant: AptarGroup, Inc., Crystal Lake, IL (US)

(72) Inventors: James Hammond, North Prairie, WI (US); Timothy Mazurkiewicz, Waukesha, WI (US); Tim Wallace, Denver, NC (US)

(73) Assignee: AptarGroup, Inc., Crystal Lake, IL (US)

( * ) Notice: Subject to any disclaimer, the term of this patent is extended or adjusted under 35 U.S.C. 154(b) by 182 days.

This patent is subject to a terminal disclaimer.

(21) Appl. No.: 15/894,310

(22) Filed: Feb. 12, 2018

(65) Prior Publication Data

US 2018/0186510 A1 Jul. 5, 2018

Related U.S. Application Data

(63) Continuation of application No. 14/774,014, filed as application No. PCT/US2015/024458 on Apr. 6, 2015, now Pat. No. 9,957,082.

(51) Int. Cl.
*B65D 17/28* (2006.01)
*B65D 51/24* (2006.01)
(Continued)

(52) U.S. Cl.
CPC ..... *B65D 17/4012* (2018.01); *B65D 17/353* (2018.01); *B65D 17/4011* (2018.01);
(Continued)

(58) Field of Classification Search
USPC ..... 220/267
See application file for complete search history.

(56) References Cited

U.S. PATENT DOCUMENTS 3,190,485 A 6/1965 D'Andrea et al.
3,434,623 A 3/1969 Cookson
(Continued)

FOREIGN PATENT DOCUMENTS

GB 2404916 A 2/2005

OTHER PUBLICATIONS

International Search Report and Written Opinion for PCT Application No. PCT/US2015/024458.

*Primary Examiner* — Anthony D Stashick
*Assistant Examiner* — Lauren Kmet
(74) *Attorney, Agent, or Firm* — Wood, Phillips, Katz, Clark & Mortimer

(57) ABSTRACT

A closure body (40) is provided for installation with a liner membrane (52) on a container (44). The closure body (40) has a peripheral portion (74) for being mounted on the container (44) around an access opening (48), and a separable portion (82) that (i) is disposed laterally inwardly of the peripheral portion (74); (ii) is initially connected to the peripheral portion (74) by at least one frangible connection (86); and (iii) can be separated from the peripheral portion (74) upon breaking of the at least one frangible connection (86). The closure body (40) has an opening member (94) that is connected with the separable portion (82) to accommodate movement of the opening member (94) relative to the separable portion (82). The opening member (94) has a grippable portion (102) and a puncture portion (106) each disposed in an initial inactive orientation relative to the separable portion (74).

18 Claims, 15 Drawing Sheets

(51) Int. Cl.
*B65D 17/353* (2006.01)
*B65D 77/20* (2006.01)
*B65D 17/42* (2006.01)

(52) U.S. Cl.
CPC ..... *B65D 17/42* (2018.01); *B65D 51/243* (2013.01); *B65D 77/2028* (2013.01); *B65D 2251/02* (2013.01); *B65D 2517/0007* (2013.01); *B65D 2517/0013* (2013.01); *B65D 2517/0016* (2013.01); *B65D 2517/0071* (2013.01); *B65D 2517/0086* (2013.01); *B65D 2517/0089* (2013.01)

(56) References Cited

U.S. PATENT DOCUMENTS

| | | | | |
|---|---|---|---|---|
| 4,212,409 | A | 7/1980 | Jeppsson | |
| 4,408,697 | A | 10/1983 | Yoshikawa et al. | |
| 4,533,063 | A | 8/1985 | Buchner et al. | |
| 4,828,135 | A | 5/1989 | Kawakami et al. | |
| 4,890,759 | A | 1/1990 | Scanga et al. | |
| 5,103,973 | A | 4/1992 | Sato | |
| 6,145,689 | A | 11/2000 | Kobayashi et al. | |
| 6,682,686 | B1 | 1/2004 | Iwasaki et al. | |
| 9,957,082 | B2 * | 5/2018 | Hammond ..... | B65D 51/243 |
| 2009/0084814 | A1 | 4/2009 | Wisniewski et al. | |
| 2011/0056945 | A1 | 3/2011 | Ramsey et al. | |

* cited by examiner

CLOSURE FOR A CONTAINER, CLOSURE COMPONENTS, AND METHOD OF USE THEREOF

CROSS-REFERENCE TO RELATED APPLICATION(S)

This application is a continuation of U.S. patent application Ser. No. 14/774,014, filed Sep. 9, 2015, which is a National Phase Application under 35 U.S.C. § 371 of International Patent Application Serial No. PCT/US2015/024458, filed Apr. 6, 2015, and those prior patent applications are incorporated here by reference in their entirety to provide continuity of disclosure, and applicant claims the benefit of those prior applications.

TECHNICAL FIELD

This invention relates to a closure for a container, closure components, and a method of use thereof.

BACKGROUND OF THE INVENTION AND TECHNICAL PROBLEMS POSED BY THE PRIOR ART

There are a variety of types of conventional closures for containers. One type of closure includes a body or base for being attached at an open end or access opening of a container that may contain contents such as a product—the closure body, container, and product together defining a "package". Products contained within the container may be fluent products, as well as non-fluent products. The closure can be molded or otherwise manufactured from a suitable material (e.g., a thermoplastic material).

With some such packages, a liner or membrane may be further included, with the liner membrane disposed across the interior of the closure body and also attached to the container access opening to seal the product from the ambient environment, and such an arrangement may further provide evidence of tampering to a user of the package. The liner membrane must be breached, pierced, torn, or otherwise separated from the package to expose the container interior. Some liner membranes may be thick, made from a durable material, or may require a seal with a high bonding strength to the container around the access opening in order to maintain desired properties of the product within the package. The inventors of the present invention have found that such liner membranes may require the application of an undesirably high force by the user to effect full or partial removal, breach, or otherwise tearing of the liner membrane.

The inventors of the present invention have determined that it would be advantageous to provide an improved closure body for use with a liner membrane and a container. In particular, the inventors have discovered that this innovative closure body design provides advantages not heretofore contemplated in the packaging industry or suggested by the prior art.

BRIEF SUMMARY OF THE INVENTION

According to one aspect of the present invention, an improved tamper-evident closure body is provided for being installed with an attachable liner membrane on a container of product to define a package wherein contents may be stored. The container is of the type having an interior in which the product is contained, an exterior, and an access opening communicating between the exterior and the interior. The container access opening can be initially occluded by the liner membrane attached to both the container and closure body around the access opening to define an installed closure on the container. The closure body has a peripheral portion for being mounted on the container around the access opening. The closure body further has a separable portion that (1) is disposed laterally inwardly of the peripheral portion; (2) is initially connected to the peripheral portion by at least one frangible connection; and (3) can be at least partially separated from the peripheral portion upon breaking of the at least one frangible connection.

The closure body further has an opening member that is connected with the separable portion to accommodate movement of the opening member relative to the separable portion. The opening member has a grippable portion and a puncture portion each disposed in an initial inactive orientation relative to the separable portion. The grippable portion is configured to be lifted away from the inactive orientation and pulled outwardly away from the peripheral portion, whereby after the closure body and liner membrane have been installed on the container with the grippable portion and puncture portion both in the initial inactive orientation, then: (a) the grippable portion can be lifted away from the inactive orientation to re-orient the opening member relative to the separable portion so that the puncture portion punctures the liner membrane; and (b) the opening member can subsequently be pulled outwardly away from the peripheral portion to break the at least one frangible connection between the separable portion and the peripheral portion.

In this one aspect of the invention, the closure body, per se, could be initially provided by the closure body manufacturer, and the closure body manufacturer could subsequently also provide a liner membrane, and attach (or otherwise assemble) the liner membrane to the closure body, whereby the assembled closure body and liner membrane together are characterized as defining a complete closure article for installing on a container of a product.

Further, it is contemplated that only the closure body, per se, may be initially provided by the closure body manufacturer, and that closure body could then be shipped to a packager that would provide a suitable liner membrane which, after the packager fills a container with product, would be installed on the filled container prior to, or with, the installation of the closure body on the container. For example, the packager could attach the liner membrane to the underside of the closure body to form a complete closure article, and then the packager could install that complete closure article on the filled container. Or alternatively, the packager could initially attach only the liner membrane on the top of the filled container, and then subsequently install and attach the closure body, per se, to both the membrane and container).

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same:

FIG. 7 shows the closure body grippable portion lifted away from an inactive orientation such that the closure body puncture portion has punctured the liner membrane;

DESCRIPTION OF THE PREFERRED EMBODIMENTS

While this invention is susceptible of embodiment in many different forms, this specification and the accompanying drawings disclose only specific forms as examples of the invention. However the invention is not intended to be limited to the embodiments so described and illustrated.

For ease of description, the closure body of this invention is described in a generally upright orientation that it could have when installed at the upper end of a container when the container is stored upright on its lower end or base. It will be understood, however, that the closure body of this invention may be manufactured, stored, transported, used, and sold in orientations other than those shown.

The closure body of this invention is suitable for use with a variety of conventional or specialized containers having various designs, the details of which, although not illustrated or described, would be apparent to those having skill in the art and an understanding of such containers. It will also be understood by those of ordinary skill that novel and non-obvious inventive aspects can be embodied in the described exemplary closure body alone.

Figure 1:
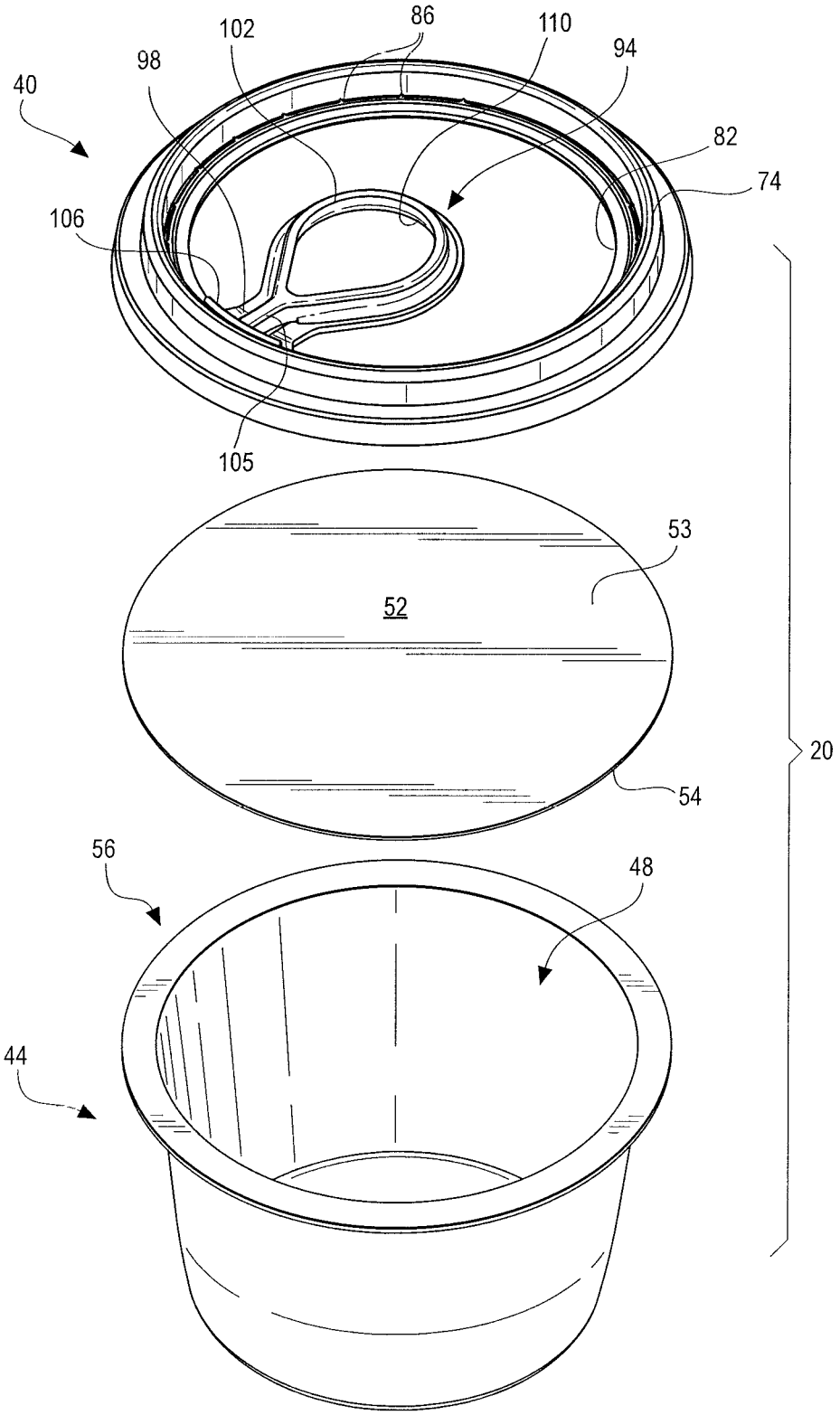
FIG. 1 is an exploded, perspective view taken from above of a package comprising a container in which a product (not visible) is stored, a closure body, and a liner membrane.
Figure 2:
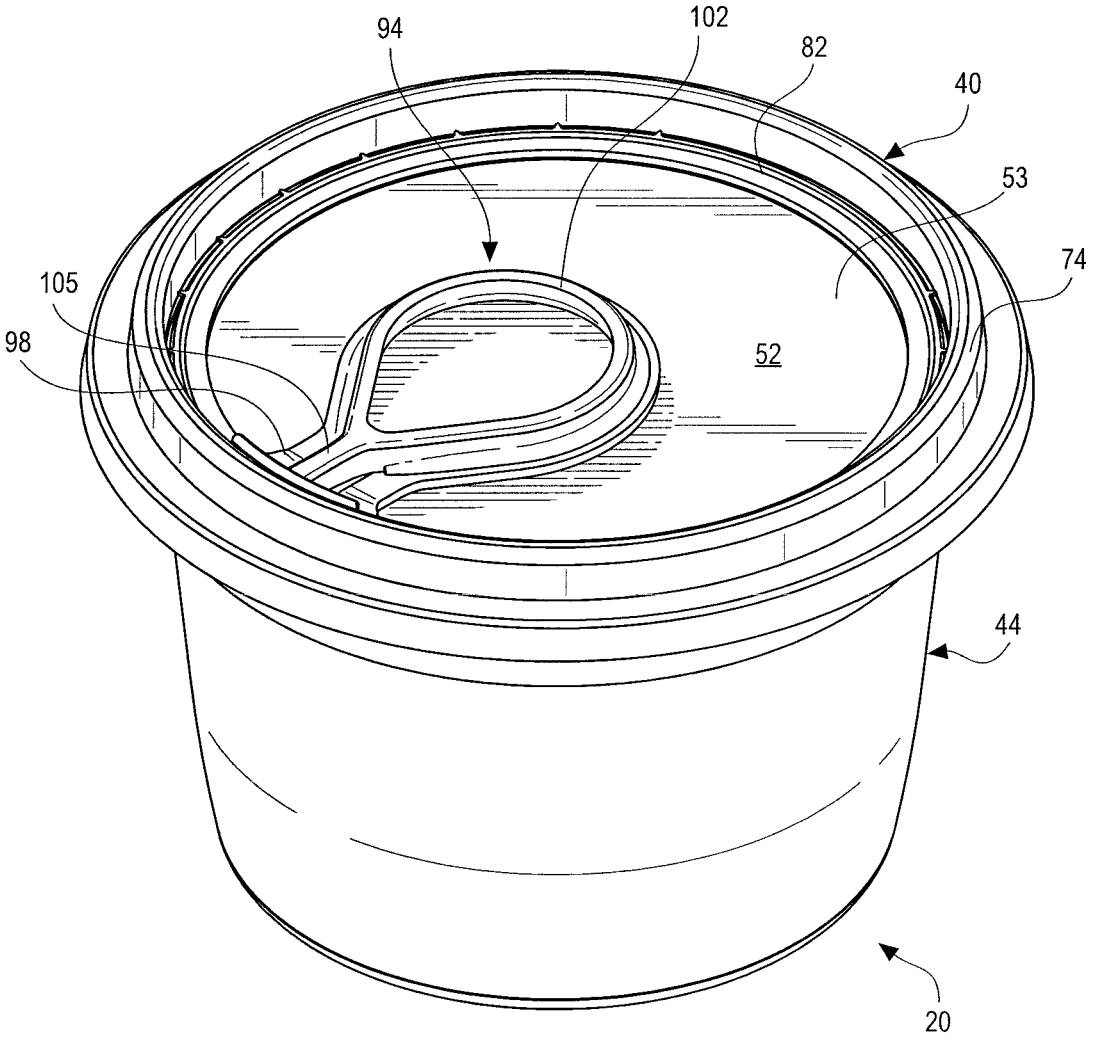
FIG. 2 is a perspective view taken from above of the package shown in FIG. 1.

A package and/or components thereof are illustrated in FIGS. 1-15 wherein the package is designated generally by reference number 20 in FIG. 1. One of the components of the package 20 is a closure body 40 of the present invention. The closure body 40 is initially provided as a separately manufactured article for being mounted to the top of a container 44. The container 44 has an upper end 56 defining a mouth or access opening 48 (FIG. 1) which provides access to the container interior where the contents, such as a product, may be contained. The product may be a relatively non-fluent material or discrete articles that can be stirred or removed with a utensil or by hand, such as infant formula, nuts, candies, powders, slurries, etc. The product may also be, for example, creamer, ketchup, jelly, etc., which can be dispensed or poured from a container by upending the container or pressurizing a portion of the container. Such materials may be sold, for example, as a food product, a personal care product, an industrial or household product (e.g., screws or washers), or other substances (e.g., for internal or external use by humans or animals, or for use in activities involving medicine, manufacturing, commercial or household maintenance, construction, agriculture, etc.).

Figure 6:
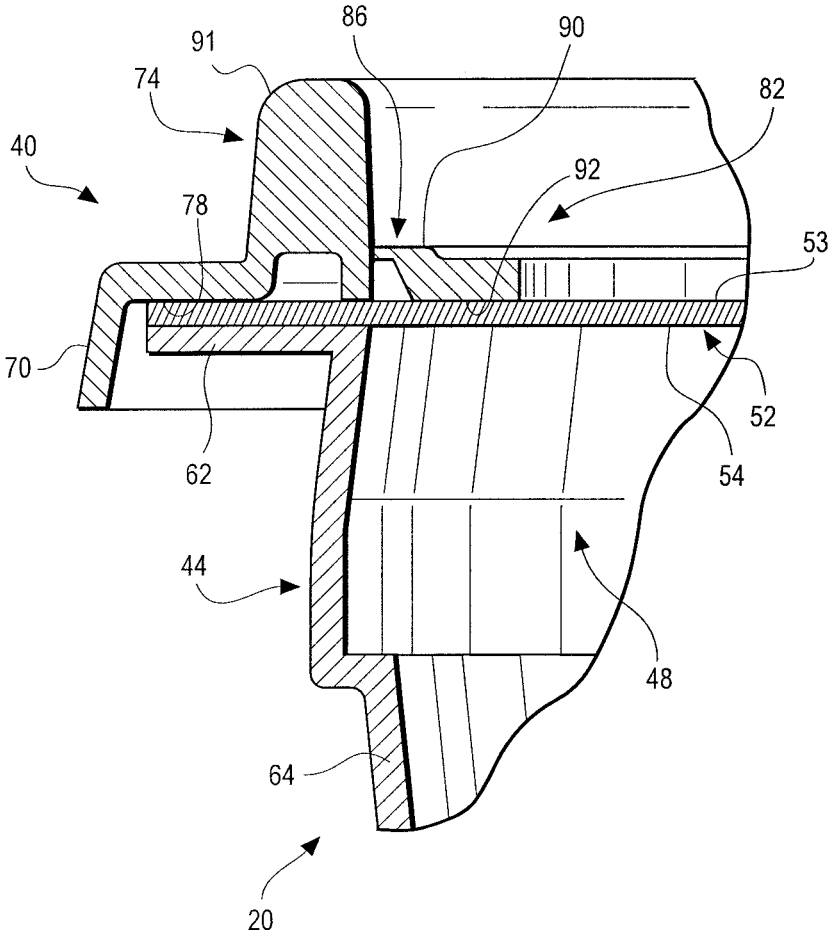
FIG. 6 is an enlarged, broken view of the package shown in FIG. 5.

Referring to FIGS. 1 and 6, a liner or liner membrane 52 has an upper surface 53 that can be disposed across, and sealed or otherwise attached to, the bottom of the closure body 40. The liner membrane further has a lower surface 54 that can also be disposed across, and sealed or otherwise attached to, the access opening 48 of the container 44 for the purposes of covering or sealing the container 44, and for attaching the closure body 40 to the container 44. The liner membrane 52 may further provide evidence of tampering with the package 20 (as will be discussed in detail hereinafter).

The closure body 40 assembled with the liner membrane 52 may collectively be referred to generally as a "closure". The assembly of the closure body 40, container 44, liner membrane 52, and contents of the container 44 are referred to generally herein as a package 20, which would typically be encountered by a customer or user. The closure body 40 of the present invention is especially suitable for use with a liner membrane 52 that is made from a foil material that includes at least one layer of metallic foil, typically aluminum, and one or more covering layers of a thermoplastic polymer or polymers that can be heat sealed to the container upper end 56 (and preferably also to the underside of the closure body 40, as will be discussed in detail hereinafter) by well-known, conventional heating methods, such as induction heating, which causes the metal layer to heat up and conduct the heat into the adjacent covering layer or layers of the thermoplastic polymer.

If the above-described metal foil liner material is used for the liner membrane 52, then the liner membrane 52 can be attached by thermal bonding (i.e., heat healing) to downwardly facing, bottom of the closure body 40. The liner membrane 52 can then also be attached by heat sealing to the upper end 56 of the container 44. Such a foil liner membrane material may be of any suitable special or conventional type. One conventional liner membrane material is a commercially available foil liner membrane material sold under the trade designation "LAMINATE 150MDPE/0.001CPP" by Coflex Packaging having an office at 1970 John-Yule Street, Chambly, Quebec, J3L 6W3, Canada (Website: www.deluxepaper.com). This liner membrane material consists of a layer of 25 micron thick aluminum foil that is (1) bonded with adhesive to a top layer of 25 micron thick cast polypropylene, and (2) bonded with adhesive to a bottom layer of 38 micron thick medium density polyethylene. Including the adhesive, the liner membrane material has a total thickness of about 94 microns and has a total basis weight of about 132 grams per square meter. This type of liner membrane 52 can be attached by conventional induction heat sealing of the liner's polypropylene upper surface 53 to the closure body 40 that is molded from polypropylene, and by conventional induction heat sealing of the liner's polyethylene lower surface 54 to a polyethylene container 44.

Although the closure body 40 of the present invention is especially suitable for use with the liner membrane 52 that has a metal foil layer, the closure body 40 may also be advantageously used with liner membranes that do not include a metal foil layer. The particular composition and thickness of the material that is used for the liner membrane 52 forms no part of the broad aspects of the present invention.

While the liner membrane 52 illustrated in FIG. 1 has the form of a disc, it will be understood that the liner membrane 52 can take a variety of shapes, and may be stamped or die cut from a sheet of the liner membrane material.

An optional lid (not illustrated) may be assembled atop the closure body 40 to at least partially cover the closure body 40. The lid may be of any suitable conventional or special design. For example, the lid could be removable, and can be initially snap fit atop the closure body 40. The lid could alternatively be connected to either the closure body 40 or the container 44 by one or more hinges or tethers, in some applications, the lid could be omitted altogether.

Referring now to FIGS. 1 and 6, the particular illustrated container 44 has a flange 62 extending laterally from the container upper end 56 for providing a surface upon which the lower surface 54 of the liner membrane 52 may be sealed or otherwise attached. However, if desired, the upper end 56 of the container 44 need not have a discernible flange 62 and may have other suitable structures that define the container access opening 48, across which the liner membrane 52 is configured to be sealed or otherwise attached.

Figure 4:
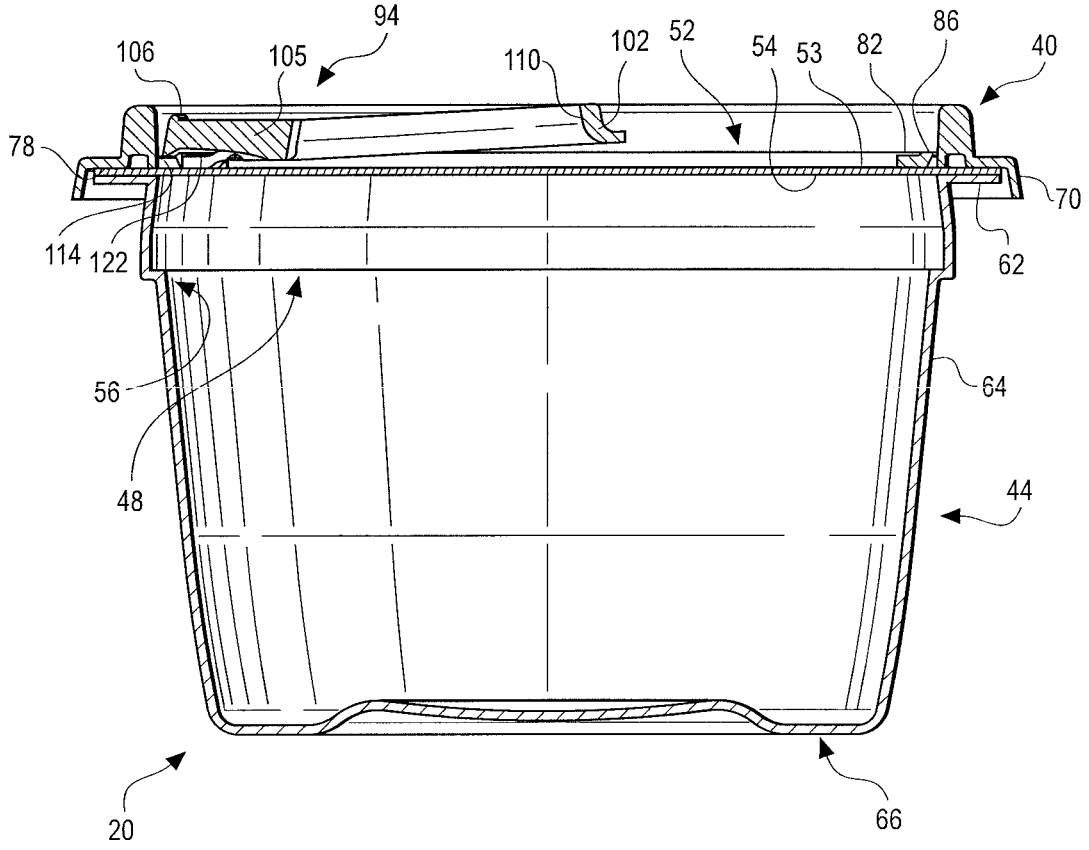
FIG. 4 is a cross-sectional view of the package taken along plane 4-4 in FIG. 3.
Figure 5:
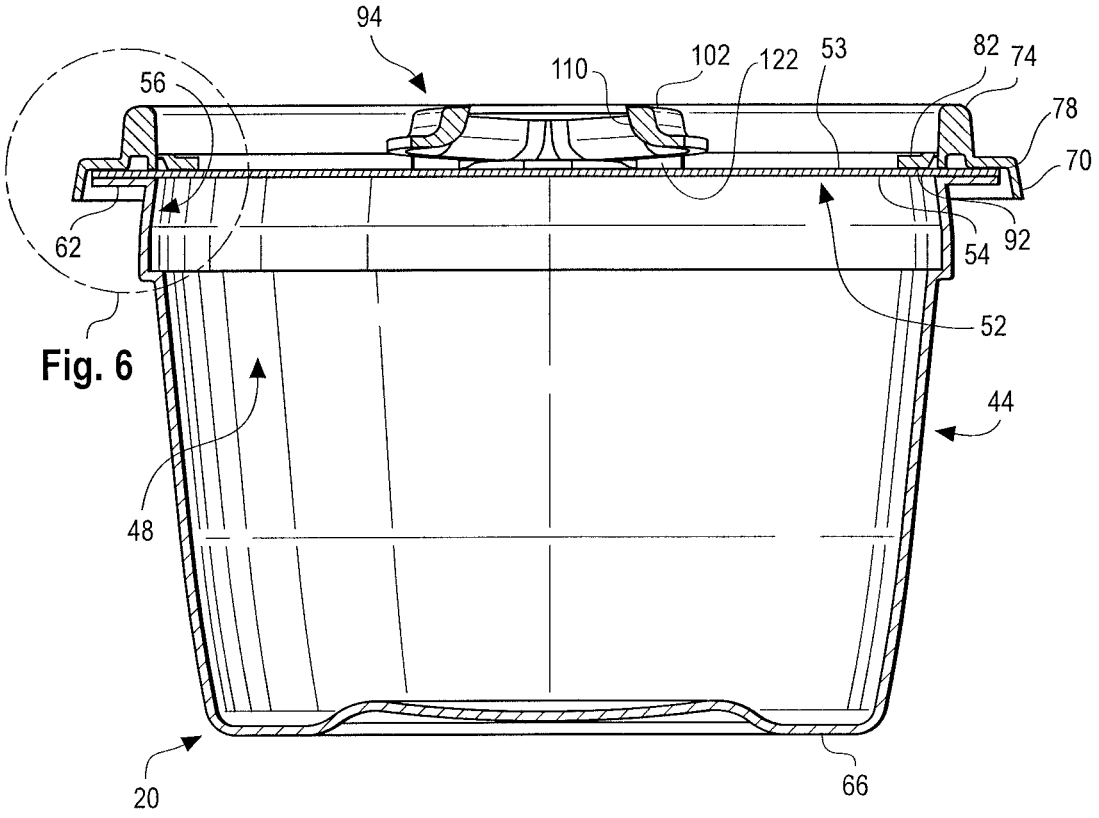
FIG. 5 is a cross-sectional view of the package taken along plane 5-S in FIG. 3.

With reference to FIG. 4, a slightly tapered wall 64 of the container 44 extends below the flange 62 and has a cross-sectional configuration that is non-uniform, but whereby the cross-sectional configuration of a container lower end 66 is smaller than the cross-sectional configuration of the container upper end 56. Alternatively, the container 44 may have a uniform cross-sectional shape along some or all of its height (not illustrated). While the container 44 is illustrated as having a wall 64 with a generally cylindrical, but slightly conical shape, it will be appreciated that the container 44 may have a variety of shapes such as polygonal tubes or other shapes defining irregular volumes—depending on the function or aesthetic design of the package 20.

The container 44 may or may not be a squeezable container having a flexible, resilient wall or walls which can be grasped by the user and compressed somewhat (i.e., temporarily, elastically deformed). The illustrated embodiment of the closure body 40 is especially suitable for use with a container 44 having a thermoplastic wall 64 that is substantially rigid and is not intended to be substantially deformed inwardly when gripped by the user during normal use when the container 44 is filled with product and held by the user.

In the embodiment illustrated in FIGS. 1-15, the closure body 40 is initially molded as a completely separate article that can be subsequently sealed with, or otherwise attached to, the upper surface 53 of the liner membrane 52. The lower surface 54 of the liner membrane 52 can also be sealed, or otherwise attached, to the container flange 62, after the container 44 has been initially filled with a product and covered with the closure body 40 and liner membrane 52. If the closure body 40 and the liner membrane 52 are initially sealed, or otherwise attached, then such a combination may be said to constitute a "closure". The closure prevents ingress or egress of the product through the container access opening 48 after the closure has been sealed, or otherwise attached, to the container 44.

A portion of the closure body 40, which extends laterally beyond the liner membrane 52, could be directly connected to the container 44 by way of a conventional snap-fit bead (not illustrated) extending along the lateral periphery of the closure body 40 for engaging a mating bead (not illustrated) extending along the lateral periphery of the container upper end 56, by mating threads on both the closure body 40 and the container 44 (not illustrated), or even by thermal bonding. In the form of the package 20 illustrated in the figures, the closure body 40 has a depending, peripheral, outer skirt 70 (FIG. 5) for surrounding the container flange 62. However, the closure body 40 need not be provided with any outer skirt 70, depending on the design of the container 44 and/or other desired design features or functional features.

As best shown in FIGS. 4 and 6, the closure body 40 defines a peripheral portion 74 that is configured to be mounted around the access opening 48 of the container 44. The peripheral portion 74 has a lower surface 78 that is configured to be sealed to the upper surface 53 of the liner membrane 52, while an opposite, lower surface 54 of the liner membrane 52 is in turn configured to be sealed to the container flange 62. As will be discussed in detail below, the peripheral portion 74 remains permanently mounted, or affixed, relative to the container access opening 48 throughout operation of the closure body 40 to open the package 20.

Figure 3:
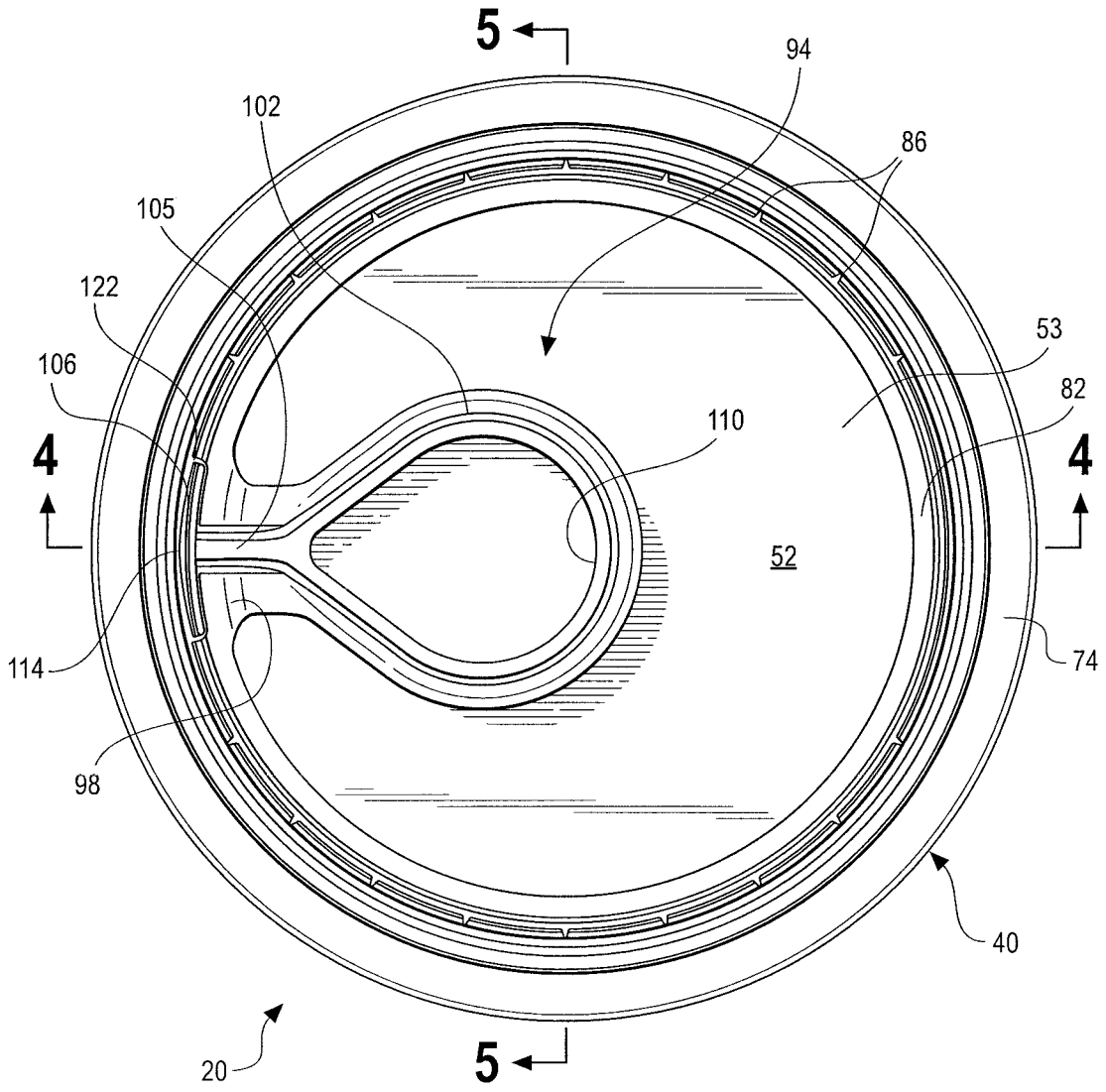
FIG. 3 is a top plan view of the package shown in FIG. 1.

Referring to FIGS. 3 and 6, the closure body 40 further has a generally ring-like separable portion 82. The separable portion 82 is connected to the peripheral portion 74 by a plurality of weakened or frangible connections 86. Each frangible connection 86 is defined by a region of reduced cross-sectional thickness compared to a laterally inward thickened portion 90 FIG. 6) of the separable portion 82, and compared to the laterally outward thickened wall 91 (FIG. 6) of the peripheral portion 74. When a user of the closure body 40 applies force to the separable portion 82 (as discussed in further detail below), the frangible connections 86 permit the user to employ a lower force to break the frangible connections 86 in order to disconnect the separable portion 82 from the peripheral portion 74. After the user has removed the separable portion 82 from the peripheral portion 74, there may be small remnants (not illustrated) of the frangible connections 86 appearing on each of the separable and peripheral portions 82,74. The separable portion 82 further has a lower surface 92 (FIG. 6) that is also configured to be sealed, or otherwise attached, to the upper surface 53 of the liner membrane 52, at a location that is laterally inward of where the peripheral portion 74 is sealed, or otherwise attached, to the upper surface 53 of the liner membrane 52.

Other means of providing a weakened connections between the peripheral and separable portions 74,82 are contemplated, such as providing only a single frangible connection 86, or providing one or more thinned regions of material (not illustrated) between the peripheral and separable portions 74,82 by way of unitary injection molding, or die cutting apertures between the peripheral and separable portions 74,82. In the broadest concept of the present invention, the separable portion 82 need not have a circular or ring-like shape, and may be provided in a variety shapes that are hollow or solid, polygonal or irregularly shaped, and/or planar shapes or non-planar.

Figure 7:
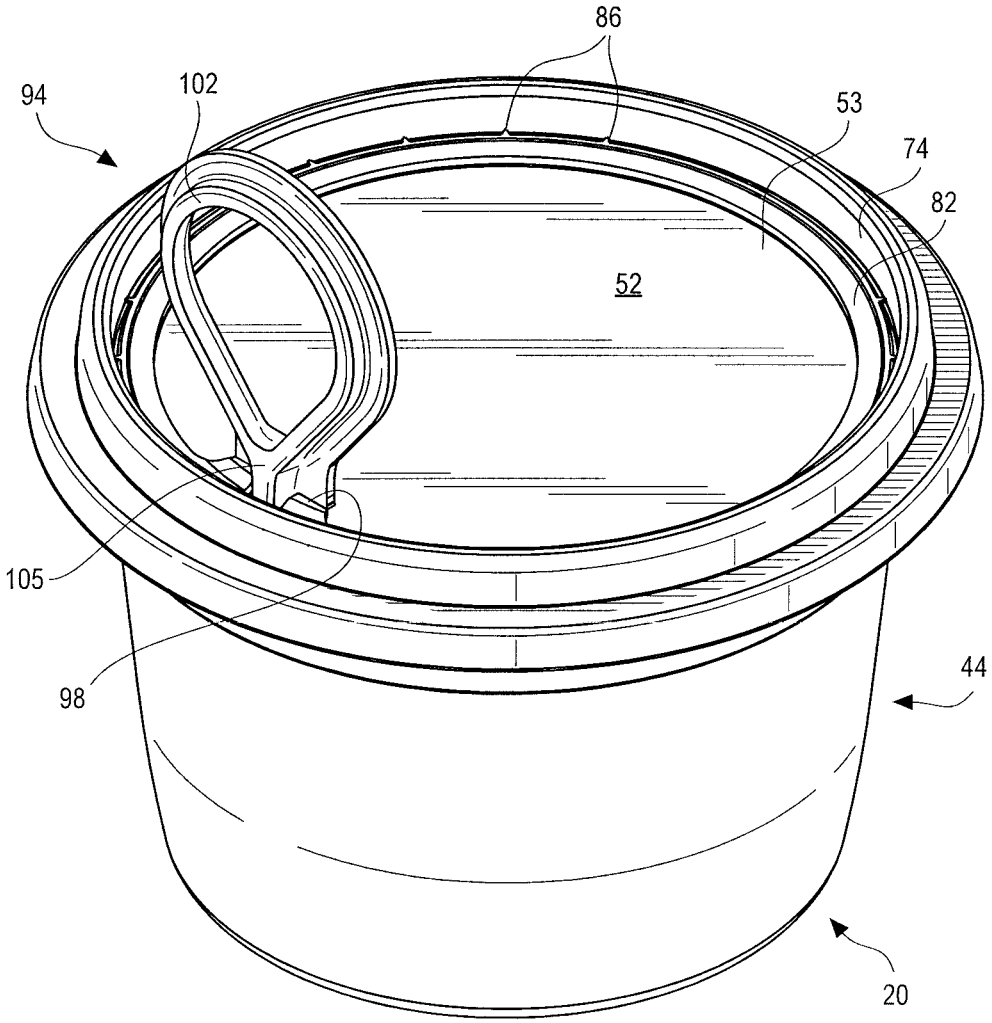
FIG. 7 is a perspective view taken from above of the package shown in FIG. 1, however
Figure 8:
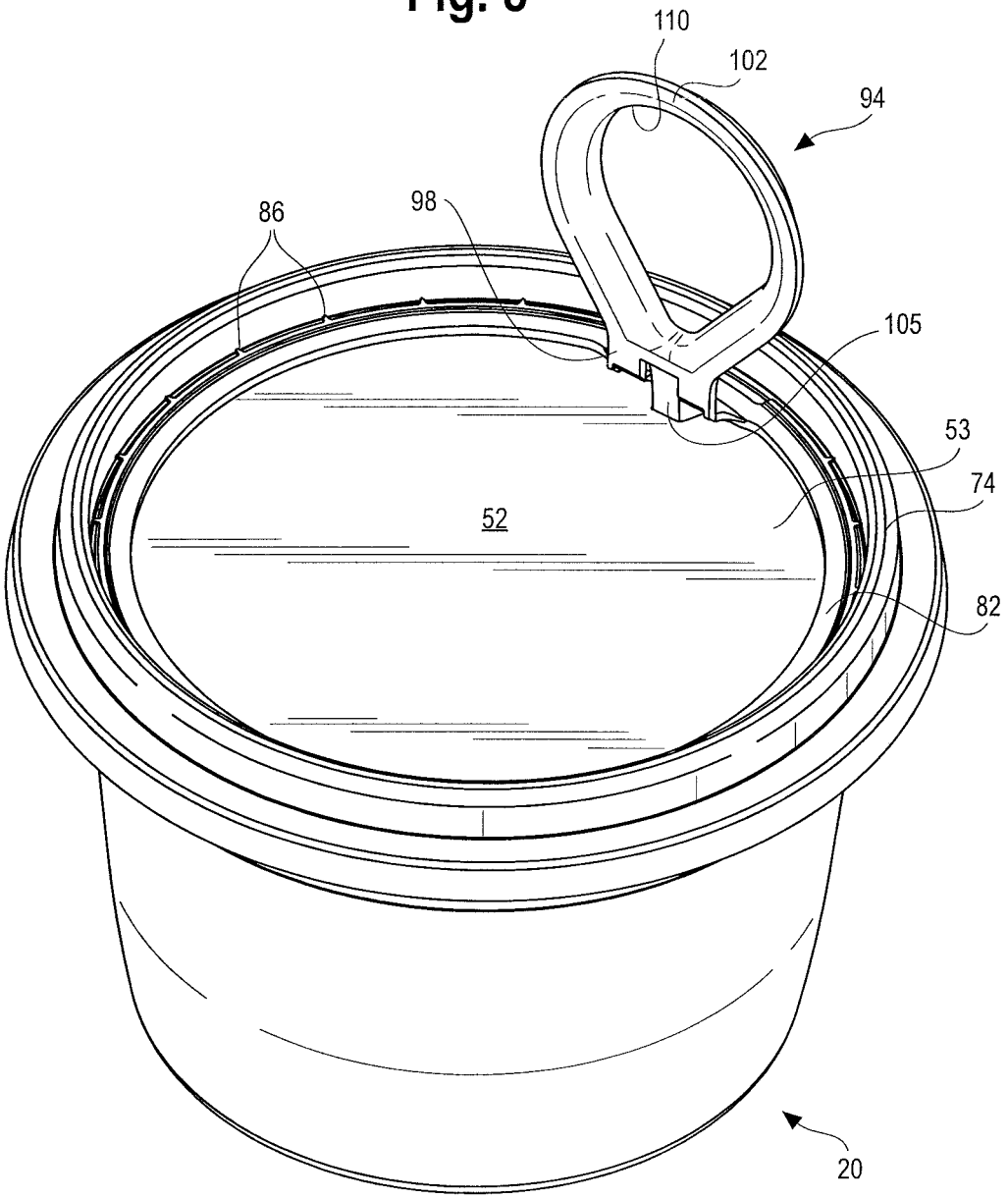
FIG. 8 is another perspective view taken from above of the punctured package shown in FIG. 7.
Figure 9:
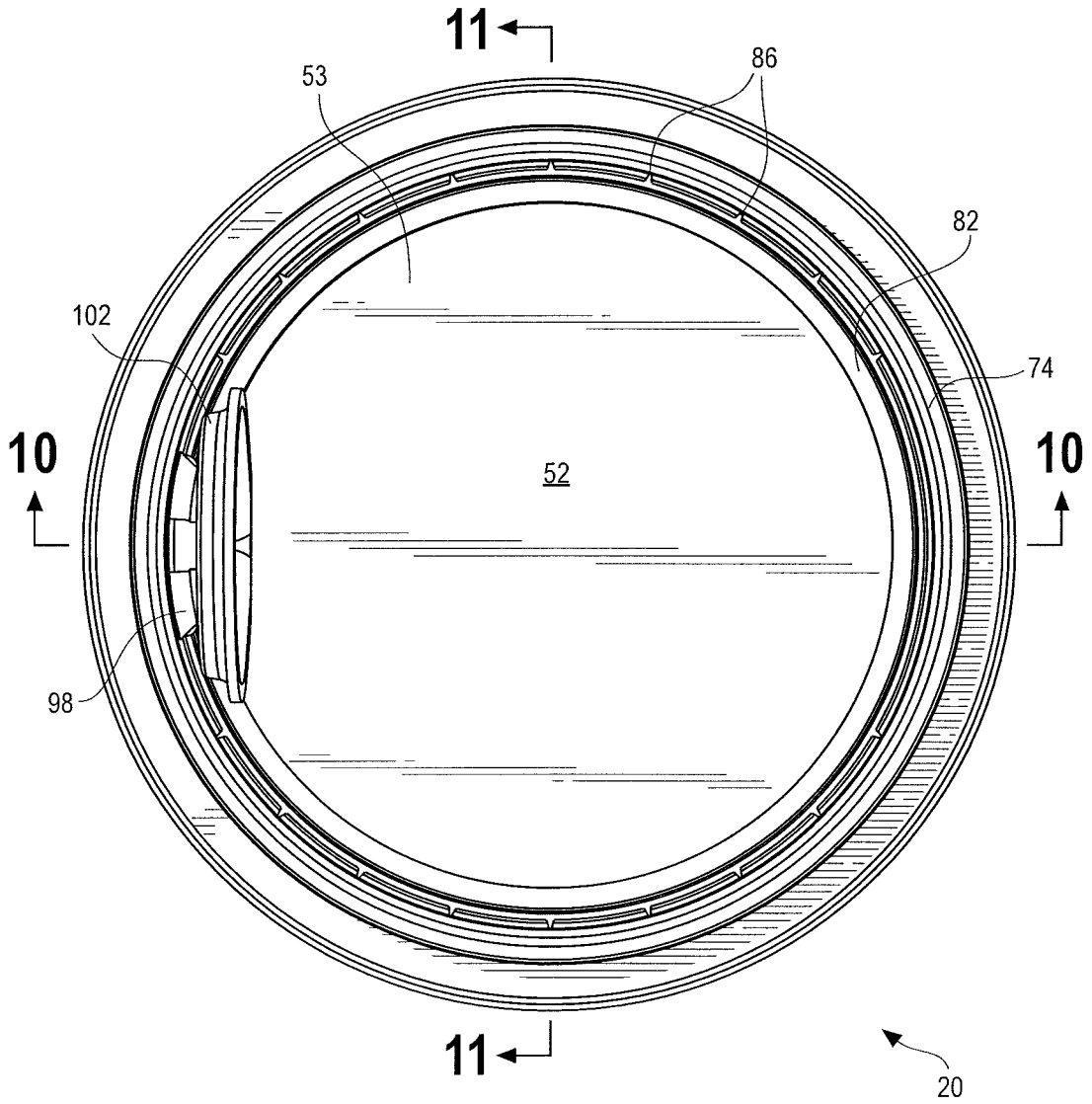
FIG. 9 is a top plan view of the punctured package shown in FIG. 7.

Referring now to FIGS. 3 and 7, the closure body 40 further has an opening member 94 that is connected to the separable portion 82 by a pair of hinges 98. The hinges 98 allow relative movement of the opening member 94 and the separable portion 82 such that the opening member 94 can pierce or tear the liner membrane 52, when the liner membrane 52 has been sealed, or otherwise attached, to the closure body 40. The hinges 98 are preferably film-type hinges, and are molded together with opening member 94, the separable portion 82, and the peripheral portion 74 as a unitary part. In the broadest concept of the invention however, the opening member 94, the separable portion 82, and the peripheral portion 74 need not be unitarily molded, and may be separate parts that are subsequently connected. It will also be understood that, in the broadest concept of the invention, the opening member 94 could be connected to the separable portion 82 by only a single hinge 98, or by an adequate mechanical joint that allows for sufficient relative movement between the opening member 94 and the separable portion 82 such that the opening member 94 may pierce or tear the liner membrane 52 as discussed in detail below.

With reference to FIGS. 3 and 4, the opening member 94 has a first end having the form of a grippable portion 102 and a distal second end having the form of a leg 105 terminating in a puncture portion 106. The grippable portion 102 defines a teardrop shaped gripping aperture 110 for accommodating a finger or thumb of the user of the package, as will be discussed in detail hereinafter. The leg 105 extends from the gripping portion 102 between the hinges 98 and terminates in a tapered or wedge shape. As can best be seen in FIG. 10, the wedge-shaped puncture portion 106 has a leading surface 107 and a trailing surface 108, which converge at a point 114 that faces the liner membrane upper surface 80, when viewed along a vertical plane through the center of the opening member 94 along its length. The leading surface of the wedged-shape puncture portion 106 is curved so as to generally follow a perimeter of the separable portion 82 along which the frangible connections 86 are located, when viewed along a horizontal plane from above the closure body 40 (as shown in FIG. 3). The wedge shape of the puncture portion 106 is suited for first initiating, and then subsequently propagating, a tear in the liner membrane 52 when the point 114 is moved into contact with the liner membrane 52 (a detailed operation of which is provided below).

As best shown in FIG. 4, the opening member 94 has an as-molded, inactive orientation whereby a majority of the opening member 94 is located generally above a plane defined by the lower surface 92 of the separable portion 82. Leg 105 is angled upwards away from the plane and terminates at the puncture portion 106 above a recess 122 in the separable portion 82. Recess 122 accommodates movement of the puncture portion 106 toward a first, upper side of the plane when the grippable portion 102 is lifted away from the upper side of the plane so as to rotate or pivot the opening member 94 about the hinges 98 (shown in FIG. 10).

Figure 10:
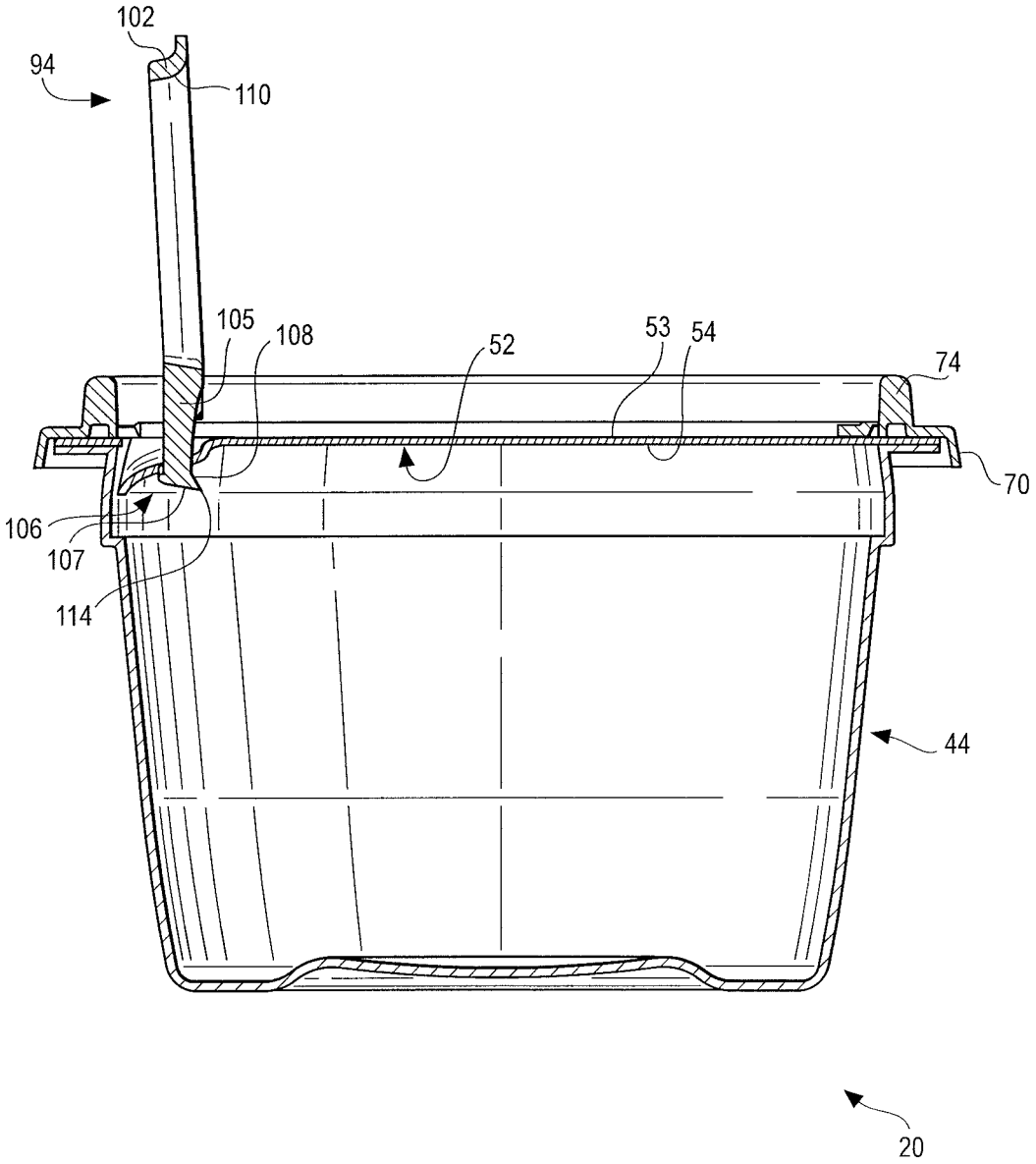
FIG. 10 is a cross-sectional view of the punctured package taken along plane 10-10 in FIG. 9.

When the grippable portion 102 is lifted away from the plane (and away from its initial inactive orientation), the opening member 94 is in an "active orientation", as can be seen in FIG. 10. As the grippable portion 102 is lifted away from the plane, the puncture portion 106 simultaneously moves toward the upper side of the plane, extends through the plane, and moves away from a second, lower side of the plane. Hinges 98 may limit the extent of movement of the puncture portion 106 away from the lower side of the plane. If the closure body 40 has been initially mounted on the container 44 with the liner membrane 52 sealed, or otherwise attached, between (i) the lower surface 92 of the separable portion 82, (ii) the lower surface 78 of the peripheral portion 74, and (ii) the container flange 62 (as best shown in FIGS. 10, 11, and 12), then such movement of the puncture portion 106 breaches the liner membrane 52 as the puncture portion 106 extends through and away from the lower side of the plane.

It will be appreciated that the opening member 94 may have a variety of shapes and need not have any discernible leg 105. Furthermore, the hinges 98 need not attached to the opening member 94 at a location intermediate the gripping portion 102 and the puncture portion 106 (not illustrated) depending on the desired motion of the opening member 94. The gripping portion 102 could be formed with plurality of gripping apertures to accommodate multiple fingers (not illustrated), or could be formed as a solid tab (not illustrated), with no gripping aperture at all.

The inventors of the present invention have found that some prior art closure bodies, which are sealed to a liner membrane, which is in turn sealed to a container around the container opening, require an undesirably high force in order to tear and separate the liner membrane from the closure body. Closure bodies of the prior art typically have one or more frangible members or connections connecting a closure body peripheral portion and a separable portion. A prior art liner membrane would be removed when the user broke the frangible connections while simultaneously initiating a tear in the liner membrane. The problem of a high force requirement to initiate a tear and/or propagate a tear can be exacerbated when one or more of the following features are present: (i) the liner membrane is relatively thick; (ii) the material or materials of the liner membrane are relatively strong; and (iii) the surface area of the liner membrane that is sealed to the closure body is relatively large compared to the surface area of the liner membrane that is not sealed to the closure body.

Figure 11:
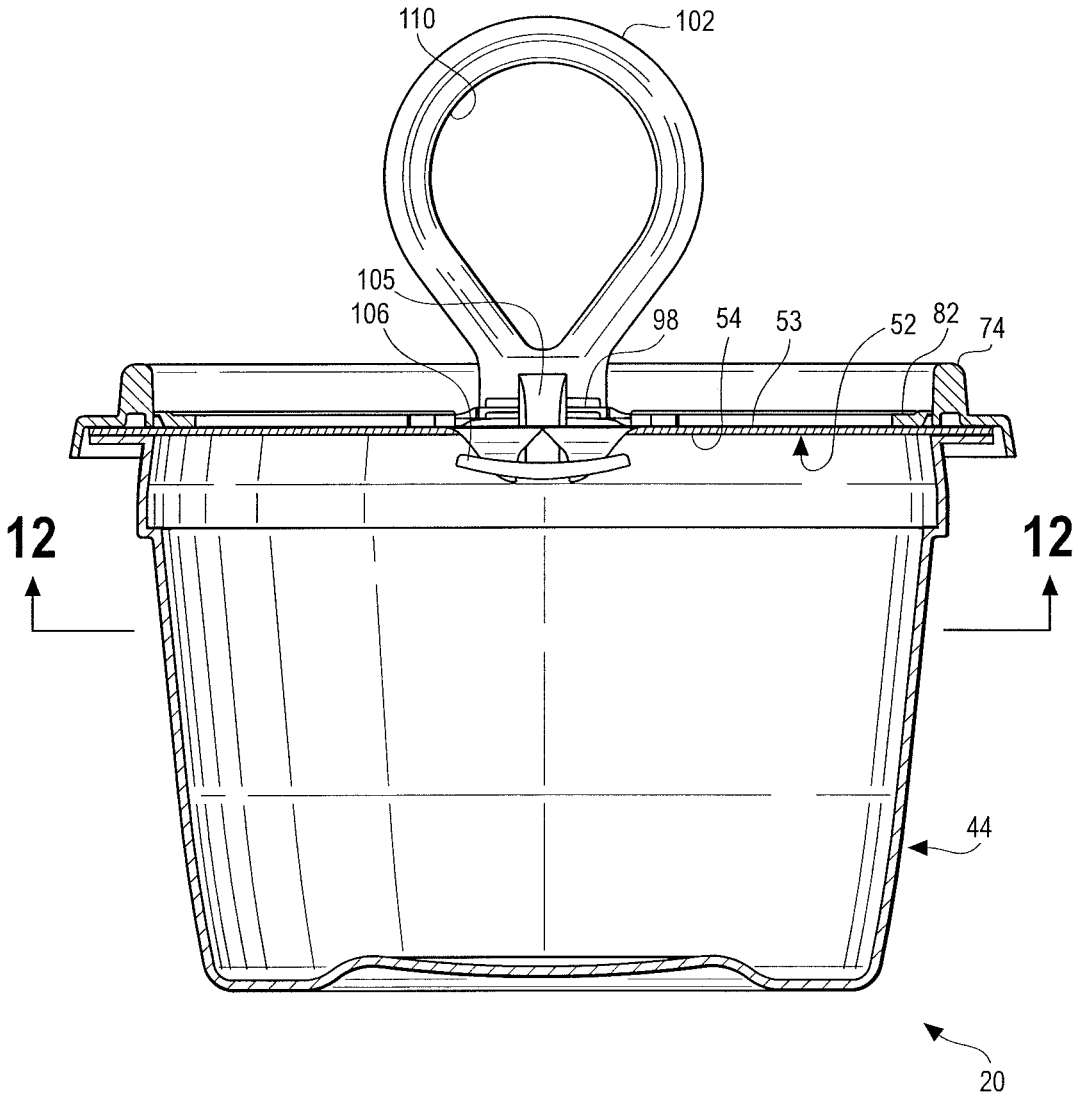
FIG. 11 is a cross-sectional view of the punctured package taken along plane 11-11 in FIG. 9.
Figure 12:
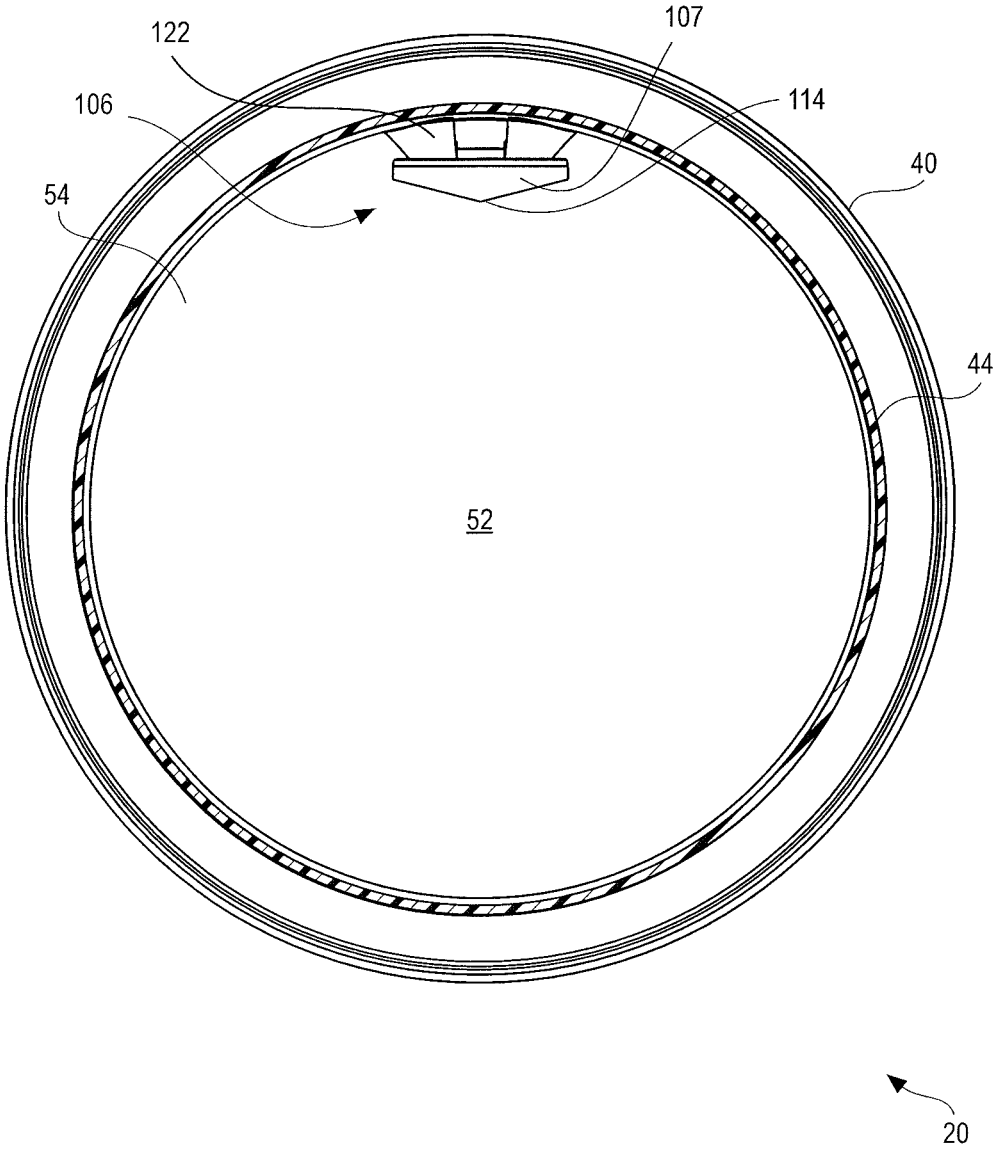
FIG. 12 is a cross-sectional view of the punctured package taken along plane 12-12 in FIG. 11.
Figure 13:
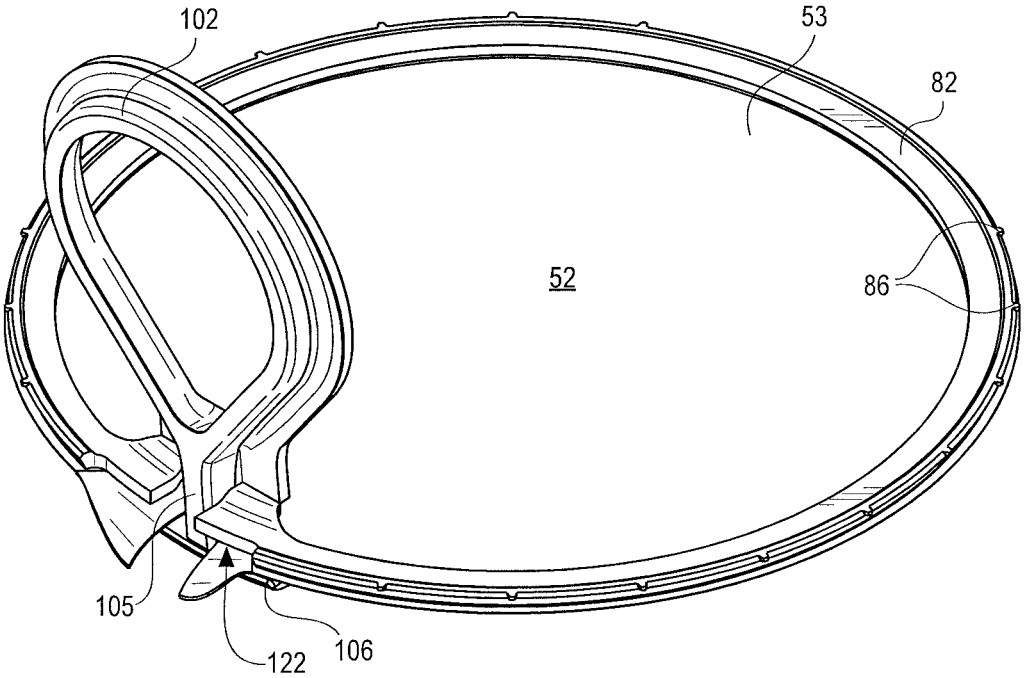
FIG. 13 is a perspective view of the separable portion of the closure body and a separable portion of the liner membrane, together removed from both the peripheral portion of the closure body and the container shown in FIG. 4.
Figure 14:
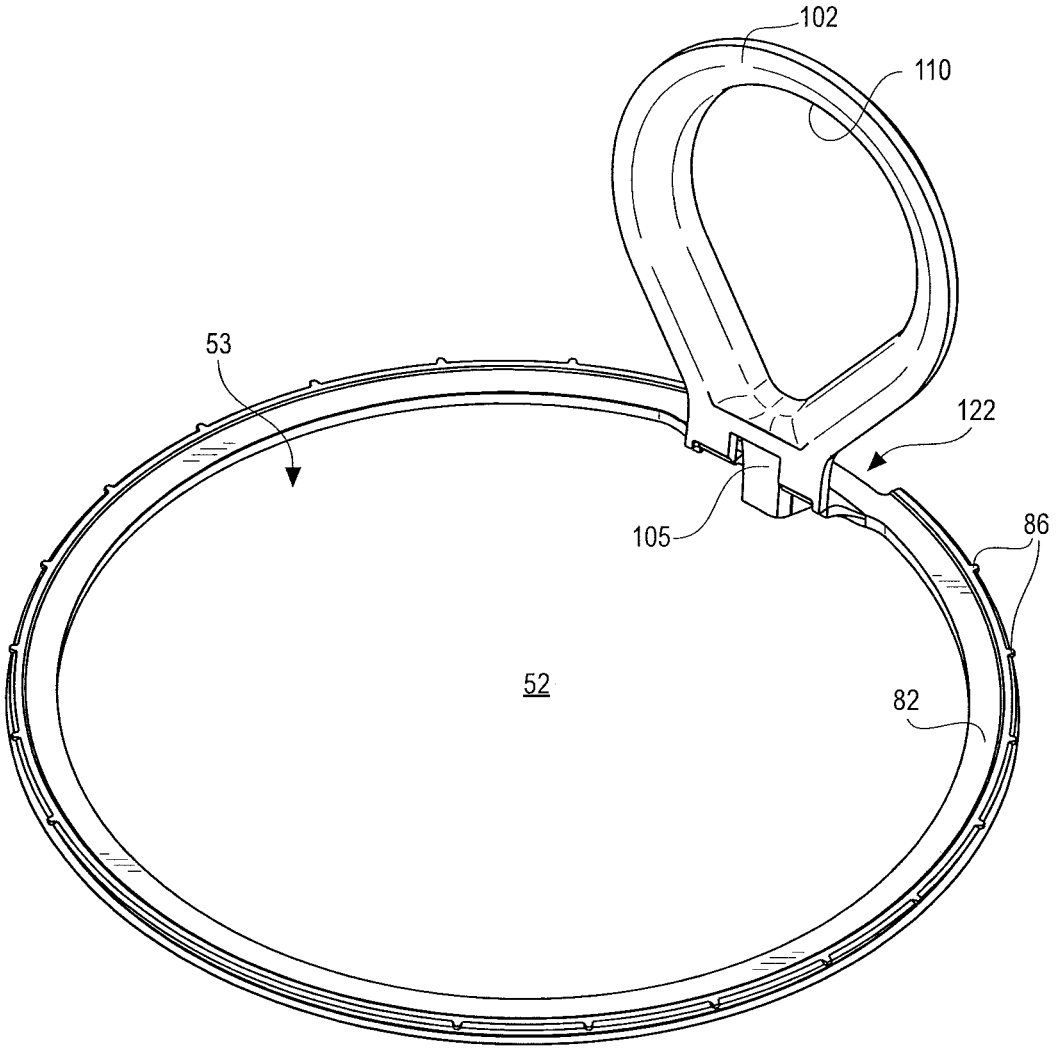
FIG. 14 is another perspective view of the separable portion of the closure body and a separable portion of the liner membrane shown in FIG. 13.
Figure 15:
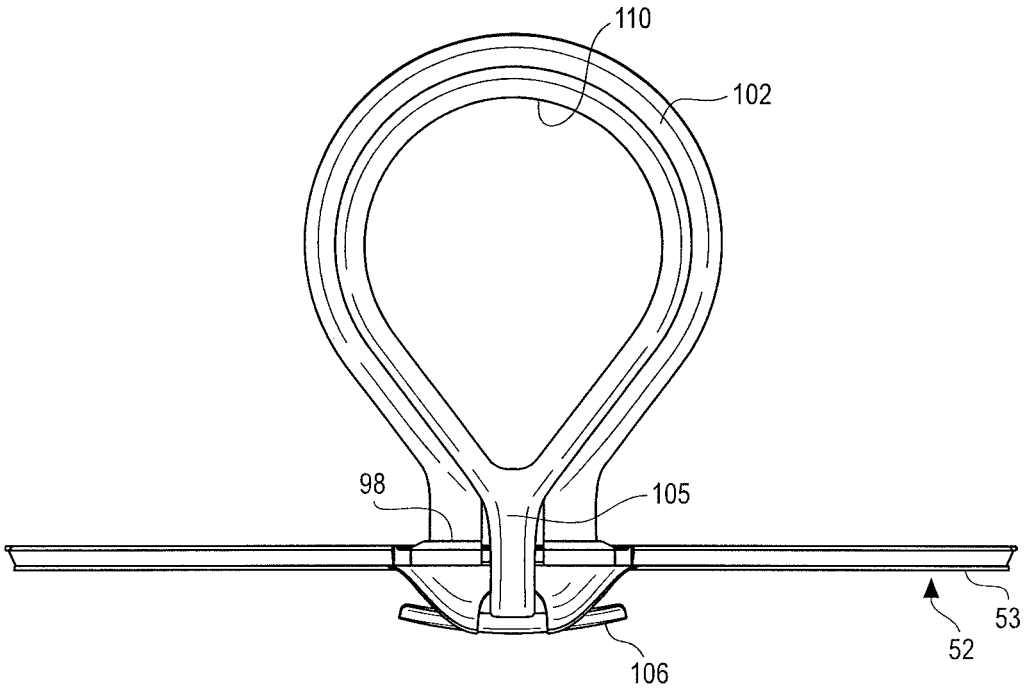
FIG. 15 is front elevation view of the separable portion of the closure body and a separable portion of the liner membrane shown in FIG. 13.

According to one aspect of the present invention, the opening member 94 is connected to the separable portion 82 by the hinges 98, providing a mechanical advantage to reduce the force required to initiate a tear in the liner membrane 52 (as shown in FIGS. 10, 11, and 12). Further, the shape of the puncture portion 106 at least minimizes or reduces, the force required to both initiate a tear and propagate the tear in the liner membrane 52 compared to prior art packages without an opening member having a puncture portion. In a typical use of the package 20, which will be discussed in greater detail below, the tear created by rotation of the opening member 94 away from its inactive position and through the liner membrane 52, allows for subsequent easy separation of the separable portion 82 from peripheral portion 74 along the frangible connections 86. Thus, undesirable high force requirements to effectuate the tearing and subsequent removal of the liner membrane 52 from the package can be eliminated or at least minimized during the separation of the separable portion 82 from the peripheral portion 74 when opening the package 20.

A typical method of using the illustrated preferred form of the package 20 (which comprises the closure body 40 attached to the liner membrane 52, which is in turn attached to the container 44 containing a product) will next be described. A user first grasps the package 20, such as by gripping around the circumference of the wall 64 of the container 44 with a first hand of the user. If a lid (not illustrated) is provided with the package 20, then the lid is removed by a second hand of the user, so as to expose the closure body opening member 94. The user then applies a force to the opening member grippable portion 102 to lift it away from the liner membrane 52 so as to puncture the liner membrane 52 with the point 114 and create a tear in the liner membrane 52. As the point 114 penetrates the liner membrane 52, the remaining portion of the wedge-shaped puncture portion 106 penetrates the liner membrane 52 to propagate the tear. This step is typically accomplished when the user grasps the grippable portion 102 between the thumb and forefinger of the second hand of the user, and then lifts the grippable portion 102 away from the liner membrane 52 to rotate the opening member 94 to puncture the liner membrane 52 with the puncture portion 106. The user then typically pulls the grippable portion 102 away from the peripheral portion 74 to pull the separable portion 82 away from the peripheral portion 74 to break the frangible connections 86 between the peripheral portion 74 and the separable portion 82. This step is typically accomplished when the user hooks the forefinger of the second hand of the user through the gripping aperture 110 and pulls the grippable portion 102 away from the container 44. Breakage of the frangible connections 86 allows for movement of the separable portion 82 away from the peripheral portion 74 and propagates the tear in the liner membrane 52. The tear in the liner membrane 52 reduces the force required to effectuate separation of the separable portion. 82 from the peripheral portion 74. The removal of the separable portion 82 propagates the tear and exposes the container access opening 48 so that the contents of the container 44 may be subsequently removed or dispensed. Continued application of force on the grippable portion 102 will result in breakage of all frangible connections 86 and the full removal of the separable portion 82 from the peripheral portion 74. When the separable portion 82 is fully removed from the remainder of the package 20, then the laterally inward portion of the liner membrane 52, which has been sealed to the separable portion 82, is also fully removed from the package 20 and remains with the separable portion 82. A remaining portion of the liner membrane 52 remains sealed between the peripheral portion 74 and the container flange 62. Breach of the liner membrane 52, in addition to movement of the opening member 94 away from the initial inactive position, may provide evidence of tampering of the package 20 to the user.

One broad aspect of the present invention relates to providing a closure body 40 initially separate and apart from a heat sealable liner membrane 52 wherein the closure body 40 includes a peripheral portion 74 for being mounted on a container 44, a separable portion 82 initially connected to the peripheral portion 74, and a puncture member 94 that can be operated to tear the liner membrane 52 disposed between the closure body 40 and the container 44 and can be subsequently operated to pull at least a portion of the separable portion 82 away from the peripheral portion 74 of the closure body 40.

In this one aspect of the invention, the closure body 40 per se could be initially provided by the closure body manufacturer, and the closure body manufacturer could subsequently provide, and attach to the closure body 40, the liner membrane 52 to constitute a complete "closure" (wherein the complete closure is defined as consisting of the closure body 40 and the attached liner membrane 52).

Further, it is contemplated that the closure body 40 may be initially provided by the closure body manufacturer, and that that closure body could be shipped to a subsequent packager that would provide a liner membrane 52 which, after the packager fills a container 44 with product, the manufacturer would install on the filled container 44 (e.g., the packager could attach the liner membrane 52 to the underside of the closure body 40 to form a complete closure, and then the packager could install that complete closure on the filled container 44, or alternatively, the packager could initially attach the liner membrane 52 to the top of the filled container 44 and then install and attach the closure body 52 to the membrane and container 44).

Further, one broad aspect of the present invention relates to providing a liner membrane 52 that is sealed, or otherwise attached, to the container 44 around the access opening 48. While the seal is preferably continuous around the access opening 48, and is thus hermetic, the seal need not be continuous or hermetic. The seal may just be sufficient to attach the liner membrane 52 to the container 44 and/or the closure body 40 for providing evidence of tampering (e.g., as a closure for a container of screws or washers).

The present invention can be summarized in the following statements or aspects numbered 1-13:

1. A closure body (40) that can be installed with an attachable liner membrane (52) on a container (44) of product to define a package (20) wherein the container (44) has (i) an interior in which the product is contained, (ii) an exterior, and (iii) an access opening (48) communicating between the exterior and the interior, and the access opening (48) can be initially occluded by the liner membrane (52) attached to both the container (44) and closure body (40) around the access opening (48) to define an installed closure on the container (44), said closure body (40) comprising:

A. a peripheral portion (74) for being mounted on the container (44) around the access opening (48);

B. a separable portion (82) that (i) is disposed laterally inwardly of said peripheral portion (74);

(ii) is initially connected to said peripheral portion (74) by at least one frangible connection (86); and (iii) can be at least partially separated from said peripheral portion (74) upon breaking of said at least one frangible connection (86); and C. an opening member (94) that (i) is connected with said separable portion (82) to accommodate movement of said opening member (94) relative to said separable portion (82);

(ii) has a grippable portion (102) and a puncture portion (106) each disposed in an initial inactive orientation relative to said separable portion (82), and wherein said grippable portion (102) is configured to be lifted away from said inactive orientation and pulled outwardly away from said peripheral portion (74), whereby, after said closure body (40) and the liner membrane (52) have been installed on the container (44), then (a) said grippable portion (102) can be lifted away from said inactive orientation to re-orient said opening member (94) relative to said separable portion (82) so that said puncture portion (106) punctures the liner membrane (52), and (b) subsequently said grippable portion (102) can be pulled outwardly away from said peripheral portion (74) so that said opening member (94) is pulled outwardly away from said peripheral portion (74) to break said at least one frangible connection (86) between said separable portion (82) and said peripheral portion (74).

2. The closure body (40) in accordance with the preceding aspect 1 further in combination with the liner membrane (52) which together define a closure and in which the said membrane (52) is of the type that is initially sealed on an upper surface (53) of said liner membrane (52) to both said separable portion (82) and said peripheral portion (74) whereby said liner membrane (52) is configured to subsequently be sealed on an oppositely facing lower surface (54) to the container (44) to occlude the container access opening (48) and seal the container (44).

3. The closure body (40) in accordance with the preceding aspect 2 in which said liner membrane (52) has a metallic component and is heat sealable on (i) said upper surface (53) to both said separable portion (82) and to said peripheral portion (74), and (ii) said lower surface (54) to the container (44).
4. The closure body (40) in accordance with any of the preceding aspects wherein said opening member (94) is connected to said separable portion (82) by a hinge (98) to accommodate rotation of said opening member (94) relative to said separable portion (82).

The closure body (40) in accordance with any of the preceding aspects wherein A. said opening member (94) is connected to said separable portion (82) with a pair of spaced-apart film hinges (98) to accommodate rotation of said opening member (94) relative to said separable portion (82);

B. said opening member (94) includes a leg (105) extending from said grippable portion (102) between and beyond said pair of spaced-apart film hinges (98); and C. said puncture portion (106) is located at the distal end of said leg (105).

6. The closure body (40) in accordance with any of the preceding aspects wherein said separable portion (82) defines a recess (122) configured to accommodate movement of said puncture portion (106) through said recess (122) when said gripping portion (102) is lifted away from said inactive orientation,
7. The closure body (40) in accordance with any of the preceding aspects wherein said puncture portion (106) is generally wedge-shaped.
8. The closure body (40) in accordance with any of the preceding aspects wherein A. said separable portion (82) has an outer perimeter;

B. said peripheral portion (74) has an inner perimeter; and

C. said at least one frangible connection (86) includes a plurality of circumferentially spaced-apart frangible connections (86) located along and between said outer perimeter and said inner perimeter.

9. The closure body (40) in accordance with any of the preceding aspects wherein said separable portion (82) has a thickened portion (90) proximal said at least one frangible connection (86).
10. The closure body (40) in accordance with any of the preceding aspects wherein.

A. said opening member (94) is connected with said separable portion (82) at a location that is intermediate said grippable portion (102) and said puncture portion (106), and B. said grippable portion (102) defines a gripping aperture (110) for accommodating insertion of a finger of the user.

11. The closure body (40) in accordance with any of the preceding aspects wherein said peripheral portion (74), said separable portion (82), and said opening member (94) all together compromise a unitary molded structure.
12. The closure body (40) in accordance with any of the preceding aspects wherein A. said separable portion (82) is generally ring-shaped and defines a plane; and B. said opening member (94) is connected with said separable portion (82) to accommodate rotation of said opening member (94) relative to said separable portion (82) to move (i) said grippable portion (104) away from said plane on a first side of said plane, and (ii) said puncture portion (106) away from said plane on an oppositely facing second side of said plane.

13. A method of using the closure body (40) in accordance with any of the preceding aspects in combination with a container (44 and a liner membrane (52) that is attached to (i) both said closure body peripheral portion (74) and said separable portion (82), and (ii) said container (44) filled with product, whereby said closure body (40) and said liner membrane (52) when attached together on and to said container (44), define an installed closure on said container (44), and whereby both said container (44) filled with product and said closure as installed on the container together define a package (20), the method comprising the steps of;

A. holding said package (20);

B. lifting said grippable portion (102) away from said liner membrane (52) to move said puncture portion (106) toward and into said liner membrane (52) to puncture said liner membrane (52) and create a tear in said liner membrane (52); and C. pulling the grippable portion (102) away from said peripheral portion (74) to break said at least one frangible connection (86) and move at least a portion of said separable portion (82) away from said peripheral portion (74) to propagate a tear in said liner membrane (52).

It will be readily apparent from the foregoing detailed description of the invention and from the illustrations thereof that numerous variations and modifications may be effected without departing from the true spirit and scope of the novel concepts or principles of this invention.

What is claimed is:

1. A closure body that can be installed with an attachable liner membrane on a container of product to define a package wherein the container has (i) an interior in which the product is contained, (ii) an exterior, and (iii) an access opening communicating between the exterior and the interior, and the access opening can be initially occluded by the liner membrane attached to both the container and closure body around the access opening to define an installed closure on the container, said closure body comprising:

A. a peripheral portion for being mounted on the container around the access opening;

B. a generally ring shaped separable portion that (i) is disposed laterally inwardly of said peripheral portion;

(ii) is initially connected to said peripheral portion by at least one frangible connection; and (iii) can be at least partially separated from said peripheral portion upon breaking of said at least one frangible connection; and C. an opening member that (i) is connected with said separable portion to accommodate movement of said opening member relative to said separable portion;

(ii) has a grippable portion and a puncture portion each disposed in an initial inactive orientation relative to said separable portion, and wherein said grippable portion is configured to be lifted away from said inactive orientation and pulled outwardly away from said peripheral portion, whereby, after said closure body and the liner membrane have been installed on the container, then (a) said grippable portion can be lifted away from said inactive orientation to re-orient said opening member relative to said separable portion so that said puncture portion punctures the liner membrane, and (b) subsequently said grippable portion can be pulled outwardly away from said peripheral portion so that said opening member is pulled outwardly away from said peripheral portion to break said at least one frangible connection between said separable portion and said peripheral portion.

2. The closure body of claim 1 further in combination with the liner membrane which together define a closure and in which the said membrane is of the type that is initially sealed on an upper surface of said liner membrane to both said separable portion and said peripheral portion whereby said liner membrane is exposed within the separable portion and is configured to subsequently be sealed on an oppositely facing lower surface to the container to occlude the container access opening and seal the container.

3. The closure body of claim 2 in which said liner membrane has a metallic component and is heat sealable on (i) said upper surface to both said separable portion and to said peripheral portion, and (ii) said lower surface to the container.

4. The closure body of claim 1 wherein said opening member is connected to said separable portion by a hinge to accommodate rotation of said opening member relative to said separable portion.

5. The closure body of claim 4 wherein

A. said opening member is connected to said separable portion with a pair of spaced-apart film hinges to accommodate rotation of said opening member relative to said separable portion;

B. said opening member includes a leg extending from said grippable portion between and beyond said pair of spaced-apart film hinges; and C. said puncture portion is located at the distal end of said leg.

6. The closure body of claim 1 wherein said separable portion defines a recess configured to accommodate movement of said puncture portion through said recess when said gripping portion is lifted away from said inactive orientation.

7. The closure body of claim 1 wherein said puncture portion is generally wedge-shaped.

8. The closure body of claim 1 wherein

A. said separable portion has an outer perimeter;

B. said peripheral portion has an inner perimeter; and

C. said at least one frangible connection includes a plurality of circumferentially spaced-apart frangible connections located along and between said outer perimeter and said inner perimeter.

9. The closure body of claim 1 wherein said separable portion has a thickened annular portion proximal to said at least one frangible connection.

10. The closure body of claim 1 wherein

A. said opening member is connected with said separable portion at a location that is intermediate said grippable portion and said puncture portion, and B. said grippable portion defines a gripping aperture for accommodating insertion of a finger of the user.

11. The closure body of claim 1 wherein said peripheral portion, said separable portion, and said opening member all together compromise a unitary molded structure.

12. The closure body of claim 1 wherein

A. said separable portion defines a plane; and

B. said opening member is connected with said separable portion to accommodate rotation of said opening member relative to said separable portion to move (i) said grippable portion away from said plane on a first side of said plane, and (ii) said puncture portion away from said plane on an oppositely facing second side of said plane.

13. A method of using the closure body of claim 1 in combination with a container and a liner membrane that is attached to (i) both said closure body peripheral portion and said separable portion, and (ii) said container filled with product, whereby said closure body and said liner membrane when attached together on and to said container, define an installed closure on said container, and whereby both said container filled with product and said closure as installed on the container together define a package, the method comprising the steps of:

A. holding said package;

B. lifting said grippable portion away from said liner membrane to move said puncture portion toward and into said liner membrane to puncture said liner membrane and create a tear in said liner membrane; and C. subsequently pulling said grippable portion away from said peripheral portion to break said at least one frangible connection and move at least a portion of said separable portion away from said peripheral portion to propagate a tear in said liner membrane.

14. The closure body of claim 7 wherein said puncture portion is arcuate and extends partially along a perimeter of said generally ring shaped separable portion.

15. The closure body of claim 7 wherein said puncture portion terminates in a point.

16. The closure body of claim 1 further in combination with the liner membrane which together define a closure, said puncture portion is completely spaced from the liner with said grippable portion in said initial inactive orientation.

17. The closure body of claim 5 wherein said puncture portion and said leg have a generally T-shaped configuration with said puncture portion extending symmetrically from opposite sides of said leg.

18. The closure body of claim 8 wherein said puncture portion is located at a first location along said outer perimeter of said separable portion and said closure body has no frangible connections between said outer perimeter of said separable portion and said inner perimeter of said peripheral portion at a second location that is diametrically opposite of said first location.

* * * * *